United States Patent [19]

Lee

[11] 4,136,726

[45] Jan. 30, 1979

[54] CAMERA CASE WITH INTEGRAL EXTENDABLE POUCH

[76] Inventor: Robert M. Lee, 16 East 53rd St., Woodmere, N.Y. 10022

[21] Appl. No.: 876,035

[22] Filed: Feb. 7, 1978

[51] Int. Cl.[2] ..... G03B 29/00

[52] U.S. Cl. ..... 150/52 J

[58] Field of Search ..... 354/288, 295; 150/52 J; 190/44, 21

[56] References Cited

U.S. PATENT DOCUMENTS

| | | | |
|---|---|---|---|
| 2,078,624 | 4/1937 | Wolff | 190/44 X |
| 2,323,053 | 6/1943 | Kupferschmid | 150/52 J |
| 4,054,167 | 10/1977 | Rausch | 150/52 J |

*Primary Examiner*—Donald F. Norton
*Attorney, Agent, or Firm*—Haseltine, Lake & Waters

[57] ABSTRACT

A camera case comprising an openable casing having an interior adapted for receiving and supporting a camera and a pouch secured to the casing and having a first retracted position within the interior of the casing and a second projecting position in which the pouch is folded inside-out and extends from the casing to form an extension thereof. The interior of the casing is in communication with the interior of the pouch such that a camera can be accommodated within the casing and an extension on the lens of the camera can be accommodated within the extended pouch.

9 Claims, 6 Drawing Figures

21
17
21
22
16
13
21
22
22
21
18
10

1
17
10
14
5
16
13
12
5
18

1
14
13
17
6
6
19
18
10

18
22
21
19
17
10
21
22
22
21
13

CAMERA CASE WITH INTEGRAL EXTENDABLE POUCH

FIELD OF THE INVENTION

The invention relates to a camera case and particularly, to such a case for 35mm cameras of both the range finder and reflex types.

BACKGROUND

In the field of 35mm cameras both of range finder and single lens reflex types, and also in the field of single lens reflex cameras using 120 film, the vast array of interchangeable lenses, motor drives and other accessories has heretofore precluded the manufacture of "universal" type cases that would be instantly adaptable to the camera and the particular lens used therewith.

By way of example, a case normally furnished with a camera will accept the camera with a standard lens and with certain lenses of shorter focal length. However, if certain sunshades are used, or if lenses with longer focal lengths or larger diameter bodies are used, the originally furnished case becomes useless.

PRIOR ART STATEMENT

The following references represent the closest prior art of which Applicant is aware.

U.S. Pat. No. 1,976,698 illustrates a bag of the duffel type, which includes a coverable opening on one end to accommodate the handle of a squash or tennis racquet.

U.S. Pat. No. 2,691,998 discloses a handbag construction which may serve for storage of flat objects and can be converted to a pouch of enlarged volume.

U.S. Pat. No. 2,323,053 discloses a camera case having a flap retained in a closed position by a single slide fastener. When the slide fastener is opened, the flap is freed, to be moved to a position behind the camera, thereby exposing all operating portions of the camera on the top thereof as well as the objective lens. FIGS. 6 to 9 illustrate the provision on the inner face of the flap for mounting the lens cap for the camera to be in a proper position when the flap is closed, to be engaged with and cover the object lens.

SUMMARY OF THE INVENTION

An object of the invention is to provide a camera case that will accommodate any number of different makes and models of camera in a certain size group without modification or adaptation.

A further object of the invention is to provide a camera case that will allow the user to interchange lenses, extension tubes, sunshades and other lens accessories.

Yet, another object of the invention is to provide a camera case that affords considerable protection against heat, cold and impact blows.

Yet, another object of the invention is to provide a camera case of flexible construction which will accept single lens reflex or range finder cameras in all current standard sizes with or without attached motor drives or self-winders.

In order to satisfy the above and further objects of the invention, there is contemplated a camera case comprising an openable casing having an interior adapted for receiving and supporting a camera, said casing including a pouch having a first retracted position within the interior of the casing and a second projecting position in which the pouch is folded inside-out and extends from the casing to form an extension thereof in which the interior of the casing is in communication with the interior of the pouch such that an extension on the camera lens can be accommodated within said pouch in extended position and be entirely covered thereby.

In further accordance with the invention, the casing is provided with a closable opening through which the pouch can be extended and retracted.

In further accordance with the invention, the pouch lies substantially flat within the casing in the retracted position and the pouch is proportioned in respect of the casing such that in the retracted position, the pouch extends substantially across the entire width of the interior of the casing at the top thereof.

The invention will next be described in greater detail with reference to the attached drawings.

DETAILED DESCRIPTION

Figures 1, 5:
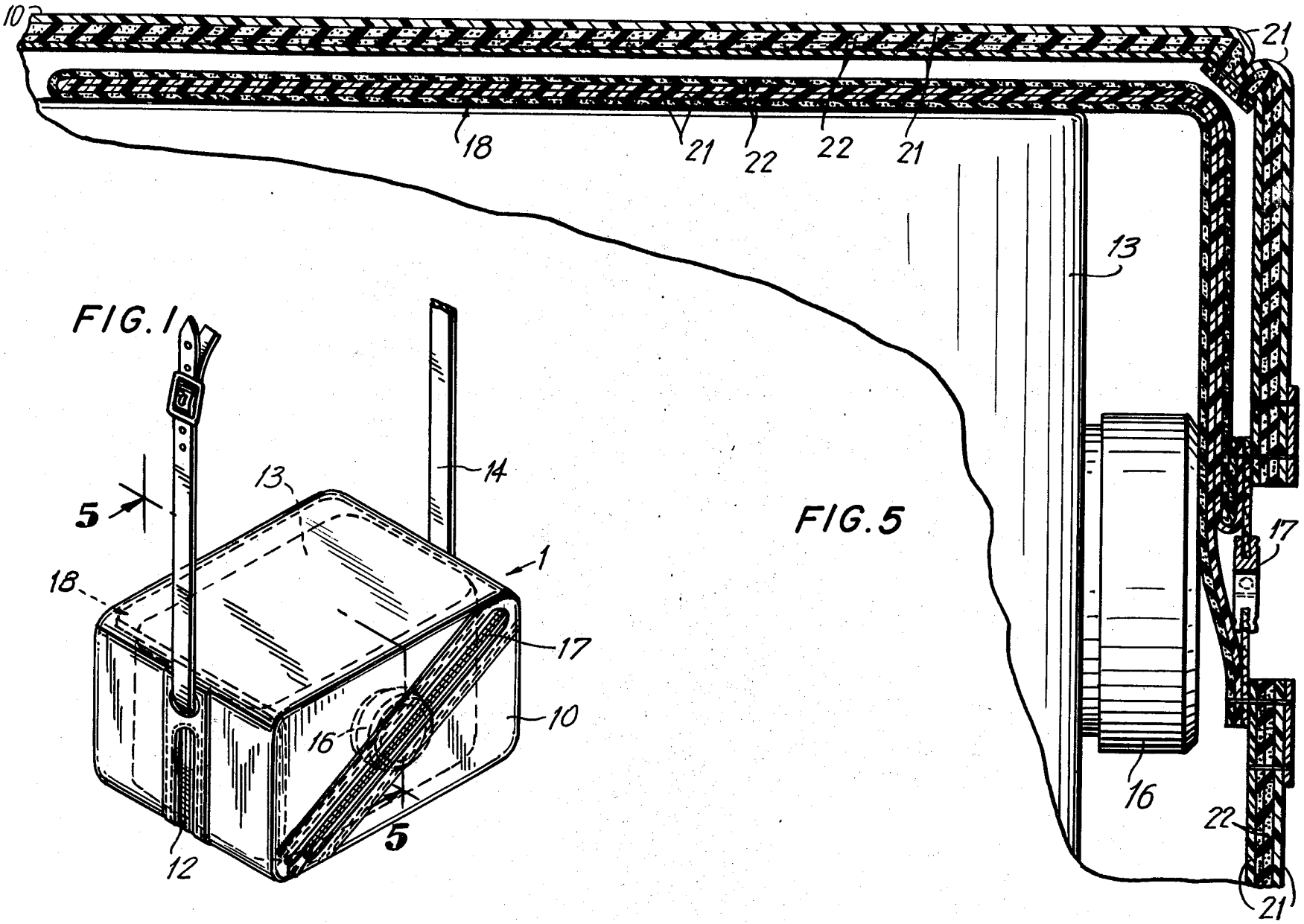
FIG. 1 is front perspective view of the camera case according to the invention with the pouch in retracted position.
FIG. 5 is a partial sectional view taken along line 5—5 in FIG. 1.

Referring to the drawing, therein is shown a camera case 1 which comprises a casing 10 made of soft padded synthetic plastic material which is capable of protecting the camera, not only against impact and shock forces, but is also resistant to high and low temperatures while also being water-resistant.

With reference to FIG. 5, therein can be seen the construction of a wall of the casing and it is seen that the wall is composed of two layers of material, each having an outer layer 21 and an inner layer 22. The outer layer is composed of a water resistant plastic material while the inner layer 22 is constituted by a relatively thick padded material of polyurethane or other similar lightweight insulating foam material. The wall of the casing could be constituted by a single layer of material of three thicknesses constituted by two outer layers 21 and a single interior layer 22.

The casing 10 is formed with a zipper closure 12 or the like which extends across the entire bottom of the casing and upwards along a substantial portion of the ends in order to provide access for the introduction and removal of a camera 13.

Figure 3:
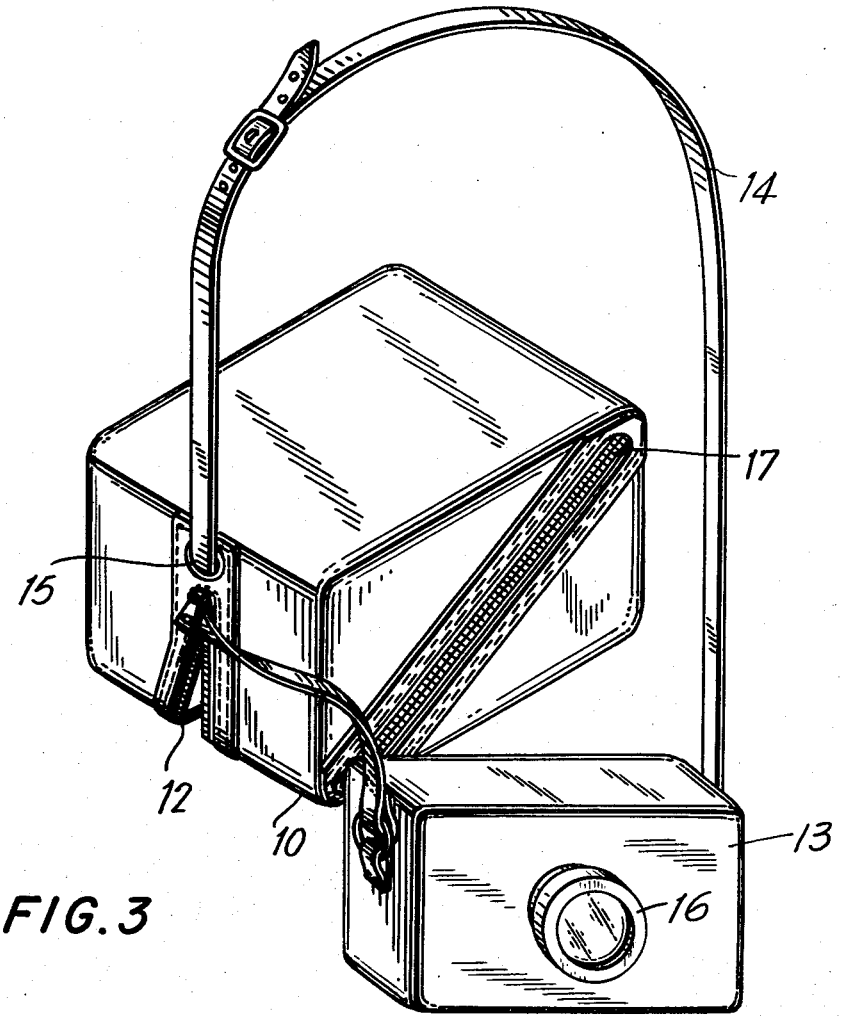
FIG. 3 shows the camera removed from the case and in operative position for use.

In FIG. 3 the camera 13 is seen removed from the case in operative position for use. A strap 14 secured to the camera 13 extends through a reinforced aperture 15 proximate the stop position of the slide of the zipper 12 in the open position thereof. Thereby, the camera and case are always supported on the neck of the user by means of the strap of the camera. The case 10 is thus supported on the strap 14 in the position of use as shown in FIG. 3.

Figure 2:
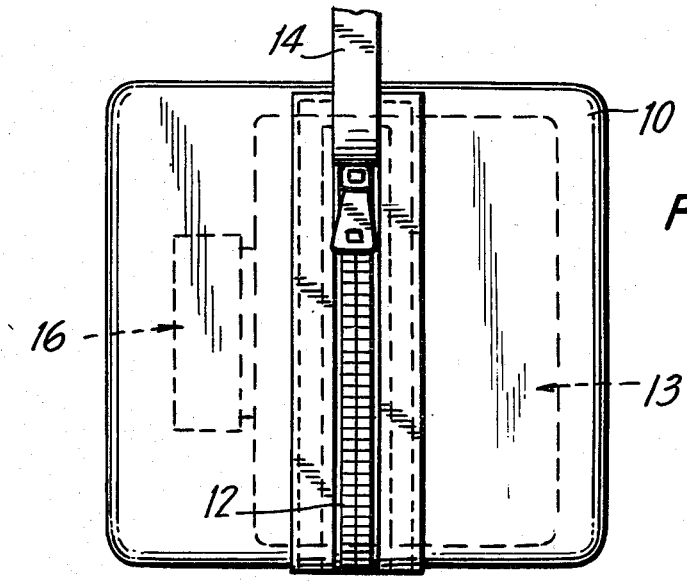
FIG. 2 is a side elevational view of the camera in FIG. 1.

When the camera is fitted in the case as shown in dotted lines in FIG. 1, and the zipper 12 is closed, one portion of strap 14 extends through the reinforced aperture 15 while the other end extends from the case at the end of the zipper closure 12 as shown in FIG. 2.

It is within the contemplation of the invention that the case can also be provided with its own independent strap if so desired.

In FIGS. 1 and 3 the lens 16 on the camera is of short focal length. This lens, for example, can be a normal 50mm lens ordinarily employed on a 35mm camera.

Figure 6:
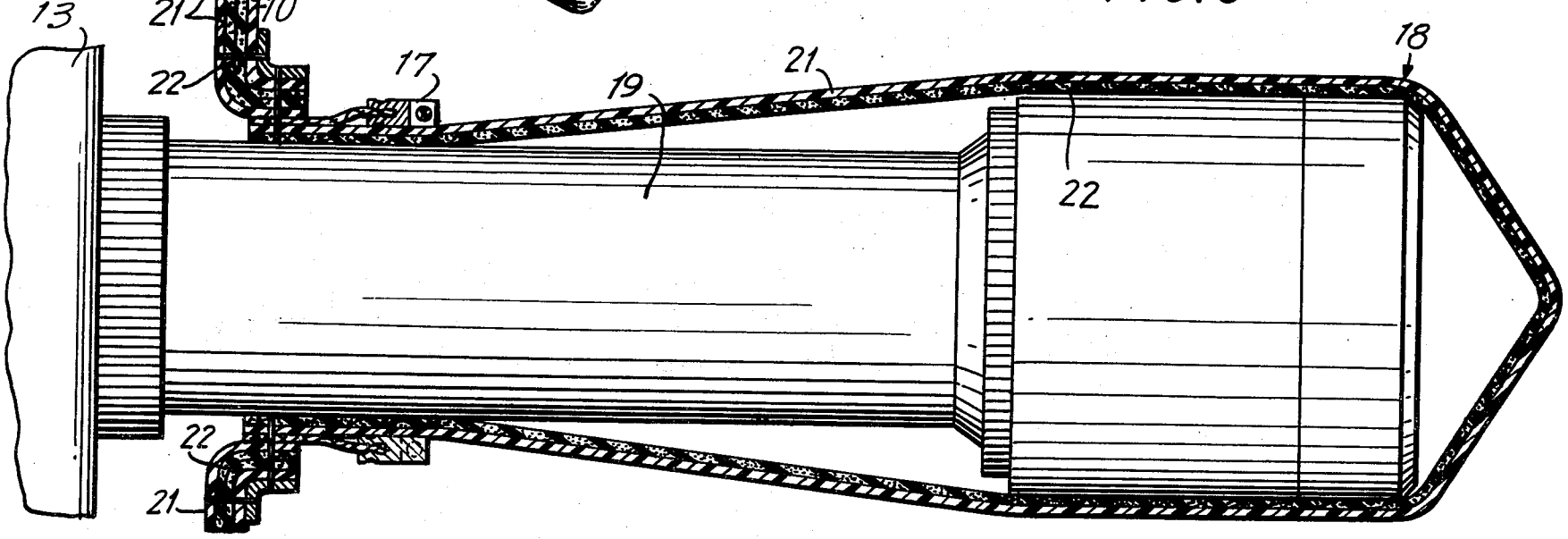
FIG. 6 is a partial sectional view taken along line 6—6 in FIG. 4.

A zipper closure 17 extends along the front wall of the casing. Attached around the opening of the zipper 17 is a pouch 18 which can be retracted within the interior of the casing in the manner as shown in FIGS. 1–3 and 5, or extended from the casing in the manner as shown in FIGS. 4 and 6.

Figure 4:
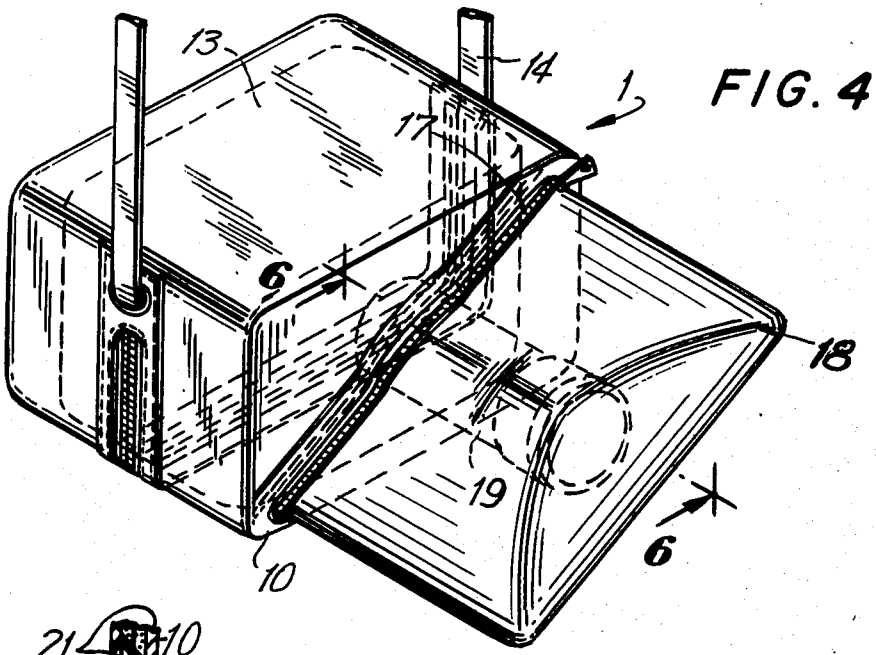
FIG. 4 shows the camera case of FIG. 1 with the pouch in extended position.

The zipper closure 17 is shown to extend diagonally in FIGS. 1, 3 and 4 to obtain maximum length therefor. However, it is within the contemplation of the invention for the zipper 17 to extend otherwise, for example, horizontally. Moreover, the zipper closure 17 can extend around into the sides of the case if necessary to accommodate particularly large diameter lenses or accessories as will become apparent hereafter.

Instead of a zipper closure at 17 and at 12 other suitable equivalent attachment means can be employed, such as a flap secured by snaps, or Velcro fasteners or the like.

As seen in FIG. 3, the pouch 18 has a wall composed of layers 21 and 22. In the projected position, when the zipper 17 has been opened, the pouch is turned inside-out and projects from the casing. In this position, the pouch forms an extension of the casing in which the interior of the pouch is in direct communication with the interior of the casing. Thus, as seen in FIGS. 4 and 6, when a lens 19 of long focal length is affixed to the camera, it can be accommodated in the pouch 18 in projected position. Furthermore, due to the attachment of the pouch within the inner surface of the front wall of the casing, there is essentially a water-tight closure for the camera and lens.

The pouch 18 is proportioned to accept lenses and accessories up to 200mm and the pouch is dimensioned with respect to the casing so that when the pouch is retracted into the interior of the casing, the pouch extends substantially across the entire width of the interior of the casing and lies substantially flat in the casing as can be seen in FIG. 5. In this position the pouch will not interfere with the insertion of the camera with the normal lens into the case.

The zipper 17 extends along a diagonal line on the front face of the casing in order to facilitate extension and retraction of the pouch 18 and also to provide a maximum width for the extension. Furthermore, this enhances the foldability of the pouch in the flat position along the interior walls of the casing and assists in keeping the pouch against the inner surface of the upper wall of the casing.

The case of the invention can accept a wide variety of single lens reflex and range finder cameras with accessories, motor drives, long lenses, extension tubes, and the like.

Although the invention has been described in conjunction with a specific embodiment thereof, it will become apparent to those skilled in the art that numerous modifications and variations can be made within the scope and spirit of the invention as defined in the attached claims.

What is claimed is:

1. A camera case comprising an openable casing having an interior adapted for receiving and supporting a camera, said casing having top and bottom walls, front and rear walls, and left and right side walls, said casing having an opening with fastener means extending across said bottom wall and upwardly along both side walls, said opening being proportioned to permit a camera to be inserted therethrough into the casing, strap means on said camera for suspension of the camera, said casing having hole means in one of said side walls such that said strap means can extend from said hole means and from said opening for the suspension of the camera and the casing thereon, said casing including a flexible pouch having a first retracted position within the interior of the casing and a second projecting position in which the pouch is folded inside-out and extends from the casing to form an extension thereof in which the interior of the casing is in communication with the interior of the pouch such that an extension on the camera lens can be accommodated within said pouch in extended position and be entirely covered thereby, said front wall of the casing being provided with an opening through which said pouch extends in the projecting position.

2. A camera case as claimed in claim 1 wherein said casing and pouch are made from soft padded material.

3. A camera case as claimed in claim 2 wherein said pouch is folded within the casing in the retracted position and lies substantially flat against the top wall.

4. A camera case as claimed in claim 3 wherein said pouch is proportioned in respect of said casing such that in the retracted position the pouch extends substantially across the entire width of the interior of the casing and covers the camera in the casing.

5. A camera case as claimed in claim 4 wherein the opening across the bottom and side walls and the opening along the front wall are respectively positioned to permit the camera to be inserted into and removed from the casing with the extension on the camera lens.

6. A camera case as claimed in claim 2 wherein said fastener means for the opening in the casing includes zipper means for opening and closing the opening.

7. A camera case as claimed in claim 1 comprising means for closing said opening in the front wall of the casing when the pouch is retracted.

8. A camera as claimed in claim 7 wherein said means for closing the opening in the front wall comprises a zipper.

9. A camera case as claimed in claim 8 wherein said opening extends diagonally along said front wall.

* * * * *